US005117754A

United States Patent [19]

Nozaka et al.

[11] Patent Number: 5,117,754

[45] Date of Patent: Jun. 2, 1992

[54] CLEANING APPARATUS FOR IMPRESSION CYLINDER OF OFFSET SHEET-FED PRESS

[75] Inventors: Yoshiki Nozaka; Shinya Fujino; Hiroshi Miyama; Isao Kawakami; Hitoshi Otsuka, all of Tokyo, Japan

[73] Assignee: Dai Nippon Insatsu Kabushiki Kaisha, Japan

[21] Appl. No.: 631,961

[22] Filed: Dec. 21, 1990

[30] Foreign Application Priority Data

Dec. 27, 1989 [JP] Japan ..... 1-336509

[51] Int. Cl.[5] ..... B41F 35/00; B41L 41/00

[52] U.S. Cl. ..... 101/425; 15/256.51; 101/423

[58] Field of Search ..... 101/423, 425; 15/256.51, 256.52; 198/494

[56] References Cited

U.S. PATENT DOCUMENTS

| | | | |
|---|---|---|---|
| 3,952,650 | 4/1976 | Lotte | 101/425 X |
| 4,344,361 | 8/1982 | MacPhee et al. | 101/425 |
| 4,757,763 | 7/1988 | MacPhee et al. | 101/425 |
| 4,953,252 | 9/1990 | Akisawa | 101/425 X |

FOREIGN PATENT DOCUMENTS

| | | | |
|---|---|---|---|
| 653028 | 5/1951 | United Kingdom | 101/423 |

*Primary Examiner*—David A. Wiecking

*Assistant Examiner*—Moshe I. Cohen

*Attorney, Agent, or Firm*—Parkhurst, Wendel & Rossi

[57] ABSTRACT

An offset sheet-fed press is provided with a cleaning apparatus for an impression cylinder. The cleaning apparatus includes a cleaning unit which includes a frame member, a magazine roll provided with a spring brake for a cleaning cloth, a wind-up roll for winding up the cleaning cloth while stepwisely transferring the cleaning cloth by a wind-up torque motor, guide rolls for guiding the cleaning cloth so that the cleaning cloth faces the outer surface of the impression cylinder between the magazine roll and the wind-up roll, and a plurality of air cylinders arranged in parallel and disposed on the rear surface side of the cleaning cloth facing the impression cylinder. The cleaning unit further includes a cleaning cloth press assembly provided with a linear press blade linerally pressing the cleaning cloth against the impression cylinder on the side of the magazine roll, a plate-like guide disposed on the side of the wind-up roll and a surface press pad pressing the surface of the impression cylinder. The surface press pad is disposed between the blade and the plate-like guide. The air cylinder acts to move the cleaning cloth press assembly along a substantially U-shaped guide so that the linear press blade moves substantially on a radial line of the impression cylinder.

16 Claims, 2 Drawing Sheets

CLEANING APPARATUS FOR IMPRESSION CYLINDER OF OFFSET SHEET-FED PRESS

BACKGROUND OF THE INVENTION

The present invention relates to an apparatus for automatically cleaning an impression cylinder of an offset sheet-fed press without manual operation.

In the known art, it is difficult to manually carry out cleaning for an impression cylinder of an offset sheet-fed press because there is less space around the impression cylinder arranged in the offset sheet-fed press and, accordingly, the manual cleaning working of the impression cylinder takes much time and labor for the worker. In order to obviate such a defect, there is provided a cleaning apparatus, as disclosed in Japanese Patent Laid-open Publication No. 63-92456 (92456/1988), in which a cleaning cloth is pressed at its rear surface to the surface of the impression cylinder by utilizing a blade.

In one example of the conventional cleaning apparatus, a cleaning cloth for cleaning an impression cylinder is moved stepwisely from a magazine roll to a wind-up roll and, simultaneously, the rear surface of the cleaning cloth is press contacted to the surface of the impression cylinder by means of a blade member, for example, while supplying a cleaning liquid. A guide member is disposed on the side of the wind-up roll so that a portion of the cleaning cloth press-contacted by the blade member maintains an arcuate contact condition along the outer surface of the impression cylinder between the blade and a guide member. The impression cylinder has a gripper member secured to a gripper shaft for holding an end portion of a sheet and a gripper escape cam is secured to the gripper shaft for preventing the gripper member projected from the surface of the gripper shaft from contacting the cleaning cloth.

The conventional cleaning apparatus of the structure described above is constructed such that the whole structure of the apparatus is rotated about a pivot axis to thereby press-contact the cleaning cloth to the impression cylinder by means of the blade member and a cleaning liquid ejection nozzle is assembled inside the apparatus. Such a cleaning apparatus is arranged as a whole at an upper portion of the impression cylinder.

However, in the sheet-fed press, it is first necessary to manually carry out the positioning operation of the blade to make uniform the precise application of the contact pressure of the blade to the impression cylinder. Moreover, the design of an attaching bracket and a body of the offset sheet-fed press must be changed in accordance with the difference of the diameters of the impression cylinders to be used and with the change of the layout of the cylinder. Furthermore, when the cleaning apparatus is arranged in the upper portion of the impression cylinder, it is necessary to pay attention to interference between the cleaning apparatus and the end portion of the sheet at the printing operation.

SUMMARY OF THE INVENTION

An object of the present invention is to substantially eliminate defects or drawbacks encountered in the prior art described above and to provide a cleaning apparatus for an impression cylinder of an offset sheet-fed press capable of being easily attached and detached with minimum design change and of precisely cleaning the surface of the impression cylinder.

This and other objects can be achieved according to the present invention by providing a cleaning apparatus for an impression cylinder of an offset sheet-fed press comprising a cleaning unit including a frame member, a magazine roll around which a cleaning cloth for cleaning an impression cylinder is rolled up, a wind-up roll disposed for winding up the cleaning cloth while stepwisely transferring the cleaning cloth from the magazine roll, guide rolls for guiding the cleaning cloth so that the cleaning cloth faces an outer surface of the impression cylinder between the magazine roll and the wind-up roll, a cleaning cloth press assembly disposed on a rear surface side of the cleaning cloth facing the impression cylinder, the cleaning cloth press assembly including a blade for linearly pressing the cleaning cloth against the outer surface of the impression cylinder, a plate-like guide and a surface press pad disposed between the blade and the plate-like guide, a guide member for guiding the cleaning cloth press assembly so that the blade moves on substantially a tangential line of the impression cylinder, and a plurality of air cylinders arranged in parallel for pressing the cleaning cloth press assembly towards the impression cylinder, a cleaning liquid applying member for applying one or two kinds of cleaning liquids on the outer surface of the impression cylinder, a member for supplying one or two kinds of the cleaning liquids to the cleaning liquid supply member, and control means for controlling the cleaning cloth press assembly and the member for supplying the cleaning liquid, and an attachment bracket to which the frame member is mounted and which is disposed at a portion near the impression cylinder.

The blade member is disposed on the side of the magazine roll, the plate-like guide is disposed on the side of the wind-up roll, and the plate-like guide has a front end not projecting from the surface press pad towards the impression cylinder. The impression cylinder is provided with a gripper member and the cleaning unit further comprises a sensor for detecting a position of the gripper member and driving the air cylinders and a member for preventing the gripper member from interfering with the cleaning cloth.

The magazine roll is provided with a spring brake and the wind-up roll is provided with a torque motor for increasing a voltage to be applied to the torque motor at a time when the cleaning cloth is wound up so that a necessary amount of cleaning cloth can be wound up.

According to the cleaning apparatus of the character described above, a plurality of air cylinders for pressing the linear press blade and the surface press pad against the outer peripheral surface of the impression cylinder are arranged in parallel on the rear surface side of the cleaning cloth facing the impression cylinder so that the press blade and the press pad can be pressed against the outer surface of the impression cylinder entirely uniformly throughout the whole lengthwise direction of the impression cylinder, whereby the surface of the impression cylinder can be uniformly cleaned under equal pressure. Moreover, the optional portion of the cleaning cloth can be controlled by selecting the desired air cylinders under the control of the control means. In this manner, the position of the gripper member of the impression cylinder can be detected by a signal from an encoder generated in response to the rotation of the impression cylinder, and the position of the cleaning cloth with respect to the air cylinder, i.e. impression cylinder, can be controlled so as to separate the cleaning cloth from the gripper member without locating the gripper escape cam which has been required in the prior art.

The surface press pad is preferably made of sponge material and the location of the plate-like guide member effectively prevents excessive deformation of the sponge pad due to the tension applied to the cleaning cloth, thus improving the cleaning effect. The location of the plate-like guide further prevents an adverse influence due to the tension of the cleaning cloth against the sponge pad, whereby the press blade can be easily directed to the radial direction of the impression cylinder, resulting in the elimination of the adverse influence of the difference of the diameters of the impression cylinders to be used and the change of the layout thereof. Moreover, since the cleaning unit can be easily detached from the bracket, the cleaning unit can be easily repaired or exchanged.

Furthermore, according to the present invention, the spring brake is provided for the magazine roll and the electric torque motor is provided for the wind-up roll, whereby the necessary amount of cleaning cloth can be wound up by increasing the electric voltage to be applied to the torque motor when the cleaning cloth is wound up, thus substantially preventing the slacking of the cleaning cloth. Moreover, the nozzle member for ejecting the cleaning liquid disposed in the cleaning unit is constructed so that a plurality of kinds of cleaning liquids are independently ejected, so that the ink which is removed only by the solvent and soil of gum which is removed only by water as well as other dirt such as paper dust can be completely cleaned.

DESCRIPTION OF THE PREFERRED EMBODIMENTS

Figure 3:
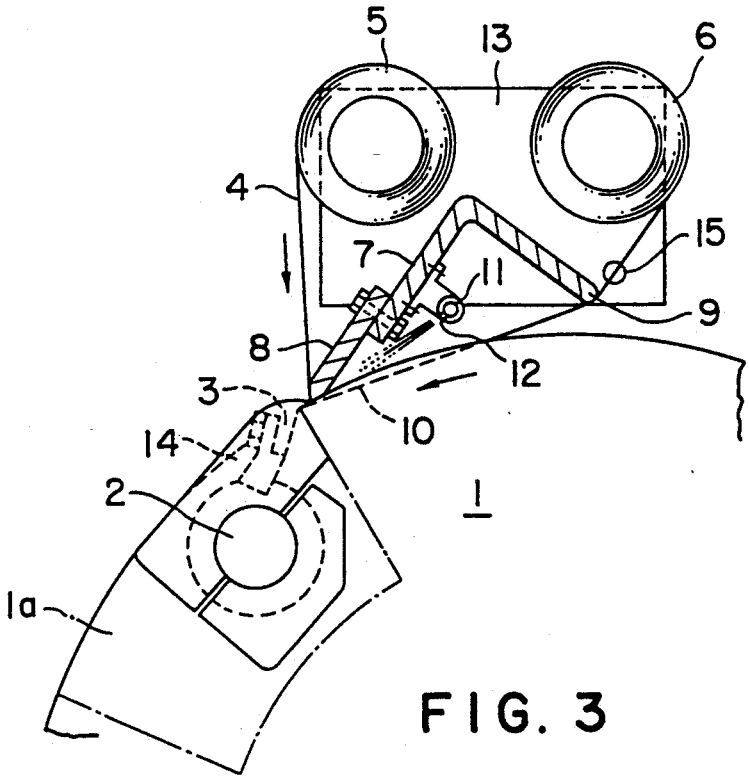
FIG. 3 is a side view of a conventional cleaning apparatus.

For a better understanding of the present invention, reference is first made, by way of one example of a conventional cleaning apparatus for the impression cylinder of an offset sheet-fed press, to FIG. 3 showing an arrangement of the cleaning apparatus with respect to the impression cylinder.

Referring to FIG. 3, a cleaning cloth for cleaning an impression cylinder 1 is moved stepwisely from a magazine roll 5 to a wind-up roll 6 and, simultaneously, the rear surface of the cleaning cloth 4 is press contacted to the outer peripheral surface of the impression cylinder 1 by means of a blade 8 while supplying a cleaning liquid. A guide member 9 is disposed on the side of the wind-up roll 6 so that a portion of the cleaning cloth is press-contacted by the blade 8 so as to maintain its arcuate contact condition along the surface of the impression cylinder 1 between the blade 8 and the guide member 9. The impression cylinder 1 has a gripper member 3 secured to a gripper shaft 2 for holding an end portion of a sheet and a gripper escape cam 14 is secured to the gripper shaft 2 for preventing the gripper member projected from the surface of the gripper shaft 2 from contacting to the cleaning cloth 4. A gripper attaching mechanism including the gripper shaft 2 and the gripper member is disposed in a cutout portion 1*a* formed in the outer surface of the impression cylinder 1.

Further, in FIG. 3, reference numeral 7 designates an angle support member constituting the blade 8 and the guide 9 at the end portions thereof, numeral 10 is an arcuate pressure-contact portion, numeral 11 is a cleaning liquid supply pipe, numeral 12 is a nozzle member for ejecting the cleaning liquid, numeral 13 is a frame and numeral 15 is a pivot axis for the frame 13.

The conventional cleaning apparatus provides problems or defects described hereinbefore.

Figure 1:
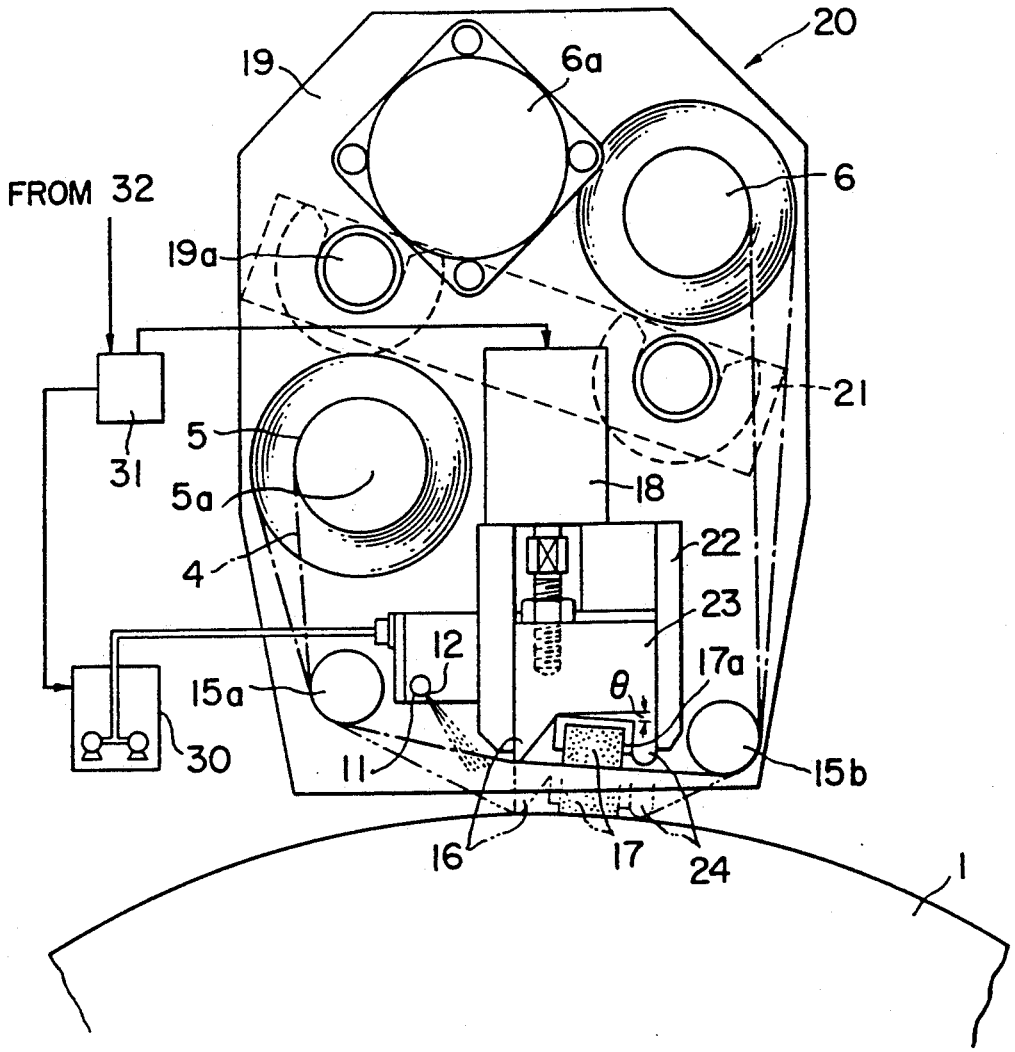
FIG. 1 is a side view of a cleaning apparatus for an impression cylinder of an offset sheet-fed press according to the present invention.

The present invention conceived by solving the problems of the prior art will be described hereunder with reference to FIGS. 1 and 2, in which FIG. 1 shows a sectional side view of a cleaning apparatus for an impression cylinder of an offset sheet-fed press according to the present invention. The cleaning apparatus is arranged in an upper portion of the impression cylinder so that the cleaning apparatus can be easily detachably mounted to the impression cylinder in view of the strength of the offset sheet-fed press without arranging rail means which is disposed by forming a hole to a frame of the offset sheet-fed press at the lower portion of the impression cylinder so as not to disturb the usual activities of an operator.

The cleaning apparatus, as shown in FIG. 1, comprises a cleaning unit 20 which includes a frame member 19, a magazine roll 5 provided with a spring brake of a cleaning cloth 4, a wind-up roll 6 for winding up the cleaning cloth 4 while stepwisely transferring the cleaning cloth 4 from the magazine roll 5 by a stepwise wind-up torque motor 6*a*, guide rolls 15*a* and 15*b* for guiding the cleaning cloth 4 so that the cleaning cloth 4 faces the outer surface of the impression cylinder 1 between the magazine roll 5 and the wind-up roll 6, and a plurality of air cylinders 18 arranged in parallel disposed on the rear surface side of the cleaning cloth 4 facing the impression cylinder 1 between the guide rolls 15*a* and 15*b*. The cleaning unit 20 further includes a cleaning cloth press assembly 23 provided with a linear press blade 16 linearly pressing the cleaning cloth 4 against the impression cylinder 1 on the side of the magazine roll 5, a plate-like guide 24 disposed on the side of the wind-up roll 6 and a surface press pad 17 pressing the surface of the impression cylinder, the plate-like guide 24 having a front end not projecting from the surface press pad 17 towards the surface of the impression cylinder 1. The surface press pad 17 is preferably made of a sponge material and is disposed in a channel shaped member 17*a* made of aluminium, for example, and between the blade 16 and the plate-like guide 24. The air cylinder 18 acts to move the cleaning cloth press assembly 23 along a substantially U-shaped guide 22 so that the linear press blade 16 moves substantially along the radial direction of the impression cylinder 1. A pipe 11 having a plurality of nozzle members 12 is mounted to the frame 19 for applying the cleaning or washing liquid to the cleaning cloth 4. The frame member of the cleaning unit 20 is detachably secured to a bracket 21 by a jig 19*a* secured to the frame member, so that the frame 19 is parallel to the impression cylinder 1.

In the described embodiment, a constant tension is always applied to the cleaning cloth 4 by utilizing, in combination, the magazine roll 5 provided with the spring brake 5*a* and the torque motor 6*a*. According to this arrangement, the slacking of the cleaning cloth which may be caused in a system using a conventional one-way clutch can be substantially eliminated. In addition, the cleaning cloth 4 can be wound up by the necessary amount by increasing a voltage to be applied to the torque motor 6a only at the cloth wind-up period, thus substantially preventing slacking of the cleaning cloth and thereby preventing interference of the gripper member of the impression cylinder to the cleaning cloth.

The linear press blade 16 is worked with aluminium material so as to have an L-shape, for example, with a point performance of about 0.02 to 0.1 mm and hard chromium plating is effected to the blade 16 for improving the durability thereof.

The surface press pad 17 is secured by a bonding agent to the inside of the aluminium channel member 17a and the channel member 17a is integrally assembled together with the surface press pad 17 between the linear press blade 16 and the plate-like guide 24. Accordingly, the integral structure of the surface press pad 17, the linear press blade 16 and the plate-like guide 24 constitutes the cleaning cloth press assembly 23, which is guided to the U-shaped guide 22 by the plurality of parallelly arranged air cylinders 18, whereby the cleaning cloth 4 is linearly pressed to the impression cylinder 1 by the linear press blade 16 and surface-pressed to the impression cylinder 1 by the surface press pad 17. For the described operation, the plate-like guide 24 is arranged on the wind-up roll side so that the blade 16 and the pad 17 are in close press contacted to the curved surface of the impression cylinder 1 and the pad 17 is not excessively deformed by the tension of the cleaning cloth 4.

The press blade 16 is disposed so that the same is displaced in the radial direction of the impression cylinder 1 and the plate-like guide is disposed so as to take a position apart from the surface of the impression cylinder 1 when the surface press pad 17 is pressed to the surface of the impression cylinder 1. The surface press pad 17 is disposed so as to have an inclination of about 5° to 15° with respect to the press blade 16 so that the surface of the pad 17 exactly faces the surface of the impression cylinder 1. In a modification, the exact facing of the pad 17 may be carried out by any other means, for example, by changing the thickness of the pad. In addition, in order to simultaneously and uniformly press the cleaning cloth 4 against the surface of the impression cylinder 1 by means of the blade 16 and the pad 17, it is necessary for the pad to have a sponge hardness of about 5° to 10° and to form the same with a material having solvent-proof property and water-proof property such as polypropylene, polyethylene or vinyl chloride.

According to the structure described above, soil including an ink or the like stuck to the surface of the impression cylinder 1 can be scraped by the cleaning cloth 4 linearly pressed by the linear press blade 16 and then wiped off by the cleaning cloth 4 pressed by the pad 17. A rotary actuator may be substituted for the air cylinder 18 and hydraulic cylinder or electrically operating cylinder may also be utilized instead of the air cylinder.

The frame member 19 of the cleaning unit 20 is secured to the bracket 21 disposed in the upper portion of the impression cylinder 1 and the plate-like guide 24 is disposed outside the linear press blade 16 with the surface press pad 17 being disposed therebetween, so that the excessive deformation of the pad 17 made of the sponge material due to the tension of the cleaning cloth 4 can be prevented. In addition, since it is possible to use the air cylinder having its long stroke, the gap between the surface of the impression cylinder 1 and the cleaning unit 20 can be made wide, thus preventing the cleaning unit from interfering with the end of the sheet. Since the linear press blade 16 is directed towards the radial direction of the impression cylinder 1, the arrangement can be made substantially regardless of the difference of the impression cylinders to be utilized and the design change due to the layout of the impression cylinder 1. Furthermore, since the cleaning unit secured to the attachment bracket is easily detachable, the remedy or exchange working of the cleaning unit can be easily carried out.

Figure 2:
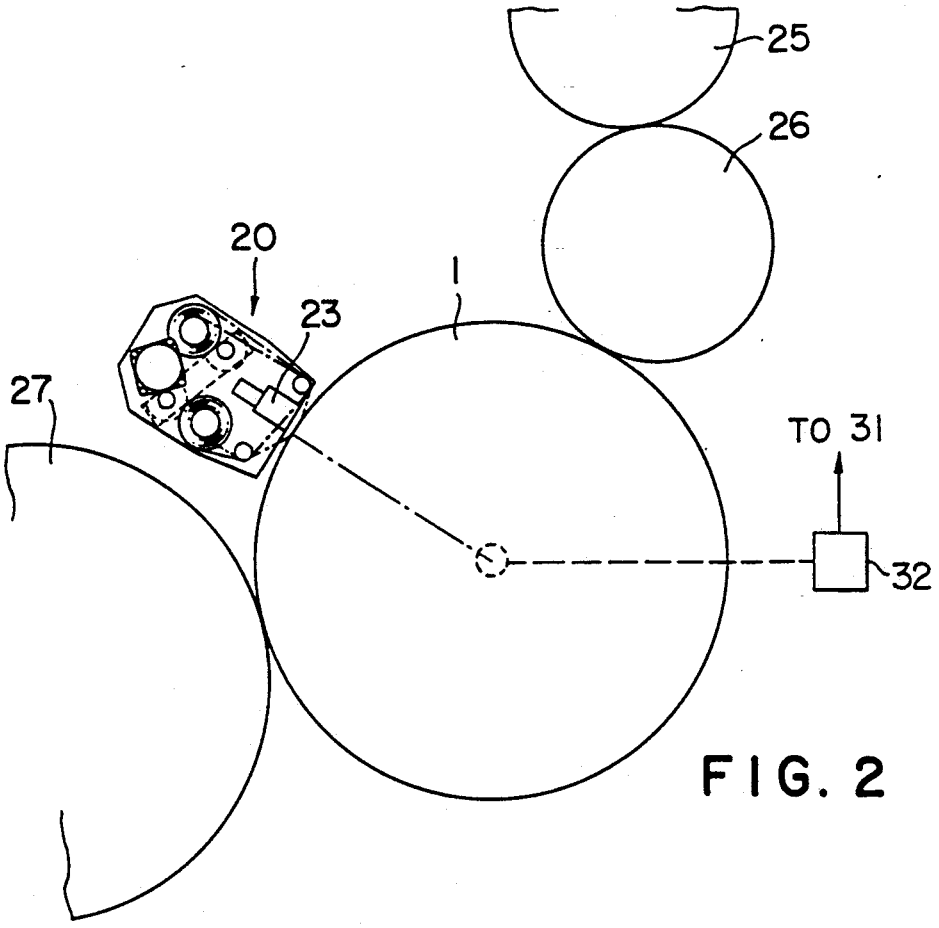
FIG. 2 shows a side view of a printing unit including the cleaning apparatus of the offset sheet-fed press.

FIG. 2 is a side view of the cleaning apparatus according to the present invention, in which the cleaning unit 20 is disposed at a left side upper portion, as viewed, of the impression cylinder 1 and in which reference numeral 25 designates a plate cylinder, numeral 26 is a bracket cylinder and numeral 27 is a transfer cylinder 27. The soil stuck to the surface of the impression cylinder 1 generally consists of an ink, gum arabic contained in water used in the printing process and paper dust, so that the water in addition to solvent is utilized as the cleaning liquid when the surface of the impression cylinder 1 is washed and cleaned. For this purpose, it is necessary to uniformly coat, with at least two kinds of cleaning or washing solvents, the entire peripheral surface of the impression cylinder 1 and, according to the present invention, there is utilized the nozzle member by perforating ejecting holes to a bronze pipe each having a diameter of 0.3 to 1.0 mmϕ with a pitch of 10 to 50 mm.

Further, as shown in FIG. 3, the impression cylinder 1 is generally provided with a cutout portion 1a and, according to the present invention, in order to uniformly coat the surface of the impression cylinder with the cleaning liquid with suitable amount of about 5 to 15 $cm^3$ so as to not prevent unnecessary liquid from being moved into the cutout portion, the cleaning liquid is supplied through both the end portions of one pipe 11 from a supplying member 30 (FIG. 1). The supplying member 30 supplys one or two kinds of cleaning liquids to the pipe 11, and is controlled by a controller 31. Furthermore, according to the present invention, the cleaning unit is designed so that the cleaning liquid is ejected just after the gripper 3 has passed by the nozzle member 12 in response to an electric signal from an encoder 32. At the same time, the air cylinder 18 is controlled by the controller 31 in response to the electric signal from the encoder 32 so that the gripper 3 does not interfere with the cleaning cloth 4. In addition, since a suitable amount of cleaning liquid once stored in a conduit tube can be entirely ejected by air, more than two kinds of cleaning liquids can be alternately supplied through the nozzle member provided for one conduit pipe. Various countermeasures for the maintenance of the offset sheet-fed press are considered and, for example, precision filters, each with meshes each having a size of 10 to 100 μm, may be disposed for the respective units of the offset sheet-fed press so as to prevent the clogging of the ejecting holes of the nozzle member. A large size filter having mesh size of about 50 μm to 1.0 mm, for example, may be provided at a portion near a water tank when water is utilized for the cleaning liquid to remove large refuse or the like before the treating of the precision filter. Furthermore, according to the present invention, although two kinds of cleaning liquids are ejected through the nozzle member provided for one pipe, more than two kinds of cleaning liquid may be utilized in accordance with the degree of the soil or contamination of the surface of the impression cylinder and, otherwise, specific nozzle members may be located for the respective cleaning liquids.

The cleaning cloth press assembly 23 is definitely separated from the impression cylinder 1 by means of the air cylinders 18 with the gap between the impression cylinder and the cleaning cloth being of about 10 to 20 mm. However, according to the present invention, a spring means as a safety mechanism is arranged for separating the press blade and the press pad from the impression cylinder at an accident such as sudden air leak and a sensor is additionally located to detect the operation of the impression cylinder pressing portion, so that in case any abnormal condition or accident is caused, the operation of the press and the cleaning apparatus can be immediately stopped. Moreover, a sensor for detecting a remaining amount of the cleaning cloth may be provided for the side plate, and a sensor for detecting a remaining amount of the cleaning liquid is disposed for the cleaning liquid tank. The cleaning cloth and the cleaning liquid can be exchanged or supplemented in accordance with the detection of these sensors. It may be possible to construct the cleaning apparatus so as not to clean the impression cylinder in the case of shortage of the cleaning cloth or cleaning liquid.

According to the present invention, since the linear press blade and the surface press pad are arranged so as to be pressed uniformly and entirely throughout the whole outer surface of the impression cylinder, the surface of the impression cylinder can be uniformly pressed, thus uniformly and effectively cleaning the entire surface of the impression cylinder. The combined use of the linear press blade and the surface press pad makes it possible to shorten the cleaning time for the impression cylinder as well as the performance of the precise cleaning effect. The cleaning effect can be highly improved by selectively operating the air cylinders under the control of the control means. The voltage is increased only at the time when the cleaning cloth is wound up by the necessary amount of the cleaning cloth by locating the spring brake to the magazine roll and the torque motor to the wind-up roll, whereby slacking of the cleaning cloth, caused in the conventional art which uses a one way clutch, can be substantially eliminated.

Moreover, according to present invention, automation of the cleaning operation can be easily performed, thus improving the workability and the productivity. The arrangement of the cleaning apparatus can be effectively improved in comparison with the arrangement of the conventional apparatus in which it is difficult to arrange the cleaning unit at the lower portion of the impression cylinder.

It is to be understood, as briefly described hereinabove, that the present invention is not limited to the described embodiment and many other changes and modifications may be made without departing from the scope of the appended claims.

What is claimed is:

1. A cleaning apparatus for an impression cylinder of an offset sheet-fed press, comprising a cleaning unit comprising:

a magazine roll for carrying a cleaning cloth for cleaning an impression cylinder;

a wind-up roll for winding up cleaning cloth transferred from said magazine roll;

guide rolls for guiding the cleaning cloth between said magazine roll and said wind-up roll; and a cleaning cloth press assembly disposed along a path of the cleaning cloth between said magazine roll and said wind-up roll, said cleaning cloth press assembly comprising:

a) blade means for linearly pressing the cleaning cloth against an outer surface of the impression cylinder, b) surface press means, disposed adjacent said blade means, for pressing the cleaning cloth against the outer surface of the impression cylinder, and c) guide means, disposed adjacent said surface press means, for contacting the cleaning cloth to prevent excessive deformation of said surface press means by tension in the cleaning cloth.

2. The cleaning apparatus of claim 1, wherein said cleaning unit further comprises means for gradually transferring the cleaning cloth from said magazine roll to said wind-up roll.

3. The cleaning apparatus of claim 2, wherein said means for gradually transferring the cleaning cloth comprises a spring break cooperating with said magazine roll, a torque motor cooperating with said wind-up roll, and means for increasing a voltage applied to said torque motor at a time when the cleaning cloth is transferred from said magazine roll to said wind-up roll to transfer a predetermined amount of cleaning cloth from said magazine roll to said wind-up roll.

4. The cleaning apparatus of claim 1, wherein said cleaning cloth press assembly is disposed on a rear surface side of the cleaning cloth.

5. The cleaning apparatus of claim 1, wherein said surface press means comprises a pad member.

6. The cleaning apparatus of claim 5, wherein said surface press pad member is made of a sponge material.

7. The cleaning apparatus of claim 5, wherein said surface press pad member has a slight inclination with respect to the linear direction of said blade means.

8. The cleaning apparatus of claim 1, wherein said cleaning unit further comprises guide means for guiding said cleaning cloth press assembly in a substantially radial direction of the impression cylinder such that said blade means moves in said substantially radial direction.

9. The cleaning apparatus of claim 8, wherein said cleaning unit further comprises a plurality of driving means for reciprocally moving said cleaning cloth press assembly along said guide means of said cleaning unit.

10. The cleaning apparatus of claim 1, wherein said cleaning cloth press assembly further comprises cleaning liquid applying means for applying at least one kind of cleaning liquid to the cleaning cloth.

11. The cleaning apparatus of claim 10, further comprising means for supplying at least one kind of cleaning liquid to said cleaning liquid applying means.

12. The cleaning apparatus of claim 11, further comprising means for controlling said cleaning cloth press assembly and said means for supplying at least one kind of cleaning liquid.

13. The cleaning apparatus of claim 10, wherein said cleaning liquid applying means comprises a pipe provided with a plurality of nozzle members for applying at least one kind of cleaning liquid to the cleaning cloth.

14. The cleaning apparatus of claim 1, wherein said blade means is disposed on the side of said magazine roll and said guide means of said cleaning cloth press assembly is disposed on the side of said wind-up roll, wherein said guide means of said cleaning cloth press assembly does not project beyond said surface press means towards the impression cylinder.

15. The cleaning apparatus of claim 12, wherein the impression cylinder includes a gripper member and said cleaning unit further comprises means for detecting a position of the gripper member and for outputting an electric signal to said control means so that the cleaning cloth does not interfere with the gripper member.

16. The cleaning apparatus of claim 1, wherein said cleaning unit further comprises a frame member and said cleaning apparatus further comprises a maintaining bracket to which said frame member is detachably mounted and which is disposed proximate said impression cylinder.

* * * * *